US005368269A

United States Patent [19]

Boisseau

[11] Patent Number: 5,368,269

[45] Date of Patent: Nov. 29, 1994

[54] ADJUSTABLE BRACING SYSTEM FOR COLUMN FORMS

[75] Inventor: Leon H. Boisseau, Disputanta, Va.

[73] Assignee: Aalpha Forming Systems, Division of Elco Concrete Co, Inc, Richmond, Va.

[21] Appl. No.: 912,980

[22] Filed: Jul. 14, 1992

[51] Int. Cl.[5] ..... F16M 13/00

[52] U.S. Cl. ..... 248/351; 248/224.2; 248/231; 249/48; 52/745.17

[58] Field of Search ..... 248/351, 300, 163.1, 248/165, 170, 166, 224.2, 231, 205.5, 206.2, 604; 249/48, 49; 47/43 R; 52/745.17; 29/897.33

[56] References Cited

U.S. PATENT DOCUMENTS

| | | | |
|---|---|---|---|
| 527,492 | 10/1894 | Hihn | 47/43 R |
| 1,021,650 | 3/1912 | Worthington . | |
| 2,058,611 | 10/1936 | Merkle | 248/224.2 |
| 2,296,217 | 5/1941 | Maloney | 248/351 |
| 2,501,255 | 5/1946 | Bell | 248/44 |
| 3,526,056 | 9/1970 | Stropkay | 248/231 |
| 3,980,268 | 9/1976 | Ellis . | |
| 4,047,356 | 9/1977 | DePirro | 249/48 |
| 4,249,342 | 2/1981 | Williams | 47/43 |
| 4,381,621 | 5/1983 | Eby | 47/40.5 |
| 4,482,124 | 11/1984 | Dochterman | 248/604 |
| 4,562,662 | 1/1986 | Ten Pas | 47/43 |
| 4,699,347 | 10/1987 | Kuhnley | 248/516 |
| 4,738,050 | 4/1988 | Dickinson | 47/43 |
| 5,117,779 | 6/1992 | Karow | 248/231 |

*Primary Examiner*—Eugenia Jones
*Assistant Examiner*—Allan M. Schrock
*Attorney, Agent, or Firm*—Wegner, Cantor, Mueller and Player

[57] ABSTRACT

A brace plate for bracing concrete column forms includes a flexible base and an extension extending at an angle therefrom. The extension has a slot for receiving a tightening strap and holes to receive fasteners for fastening the brace plate to a brace. In use, a plurality of brace plates are disposed around the circumference of a column form so that the bases conform to the outer surface of the column form. The tightening strap is inserted through each of the brace plates and drawn snugly around the column form. Each brace plate is fastened to its corresponding brace in such a way as to allow relative movement between the brace plate and the brace. Once the braces are secured and the column form is aligned, each brace plate is further fastened to each brace so as to prevent relative movement between each brace plate and its corresponding brace.

4 Claims, 4 Drawing Sheets

ADJUSTABLE BRACING SYSTEM FOR COLUMN FORMS

FIELD OF THE INVENTION

The present invention is directed to a bracing system for bracing a concrete column form while the concrete column sets and, more particularly, to a bracing system which is adjustable to brace column forms of virtually any diameter and at essentially any elevation on the column form, and a brace plate for use in the system and a method of use thereof.

BACKGROUND OF THE INVENTION

In the past, bracing collars were constructed out of lumber and plywood, or molded out of plastic, or fabricated from steel. Typically, the collar rested on the top of the form. Alternatively, the collar fitted loosely around the circumference of the form near the top end of the form. Once the column form was properly aligned, braces were attached to the collar to hold the column form in place.

These known collars were disadvantageous for bracing column forms because they had to be made to fit a particular diameter form. Additionally, they had to be installed at or near the top end of the form so that the length of the braces had to vary depending on the height of the column form. If the collar was installed around the circumference of the form, there would be some play between the column form and the loosely fitting collar, so that correct alignment of the form, and hence that of the resulting concrete column, could not be ensured.

SUMMARY OF THE INVENTION

The present invention is directed to an adjustable bracing system for bracing a concrete column form while the concrete column sets. The system includes a brace plate having a base which rests against the column form and an extension which can be affixed to a wood brace. The extension includes a slot through which a tightening strap is run.

In use, a plurality of brace plates are attached to the tightening strap by running the tightening strap through the slot in each of the brace plates. The tightening strap is wrapped around the column form with the base of each brace plate substantially flush against the column. Each brace plate is temporarily attached to a wood brace, preferably using a single double-headed nail, and the bases of the wood braces are secured. The alignment of the column form then is adjusted until the column form is properly aligned. Once the column form is set properly, another nail is used to attached each brace plate to its corresponding wood brace.

In this way, column forms of virtually any diameter can be braced limited only by the length of the tightening strap. Moreover, the brace plates need not be located at the top of the column form, but can be used essentially anywhere along the length of the column form.

DETAILED DESCRIPTION OF THE PREFERRED EMBODIMENTS

Figure 1:
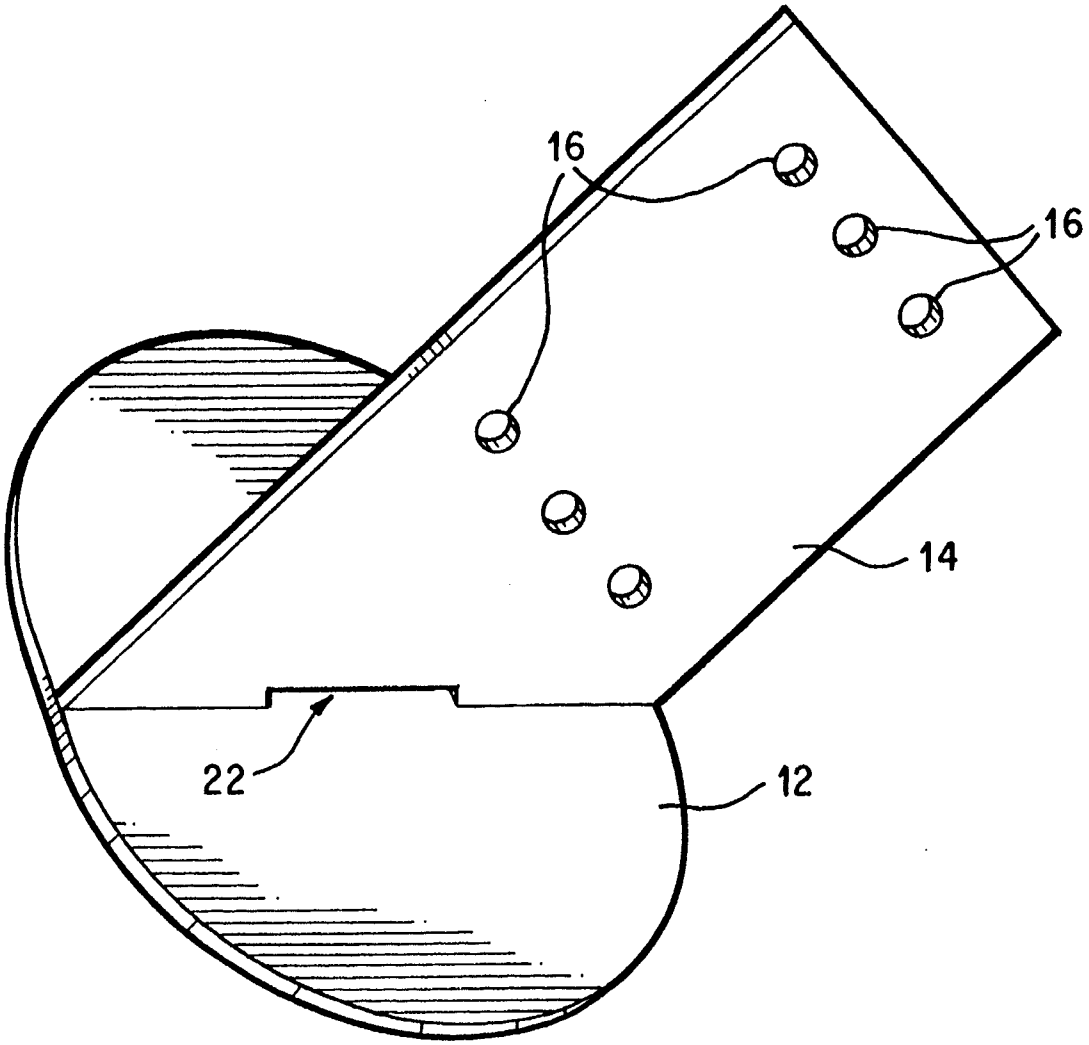
FIG. 1 is a perspective view of a brace plate for use in the system according to a preferred embodiment of the present invention.
Figure 2:
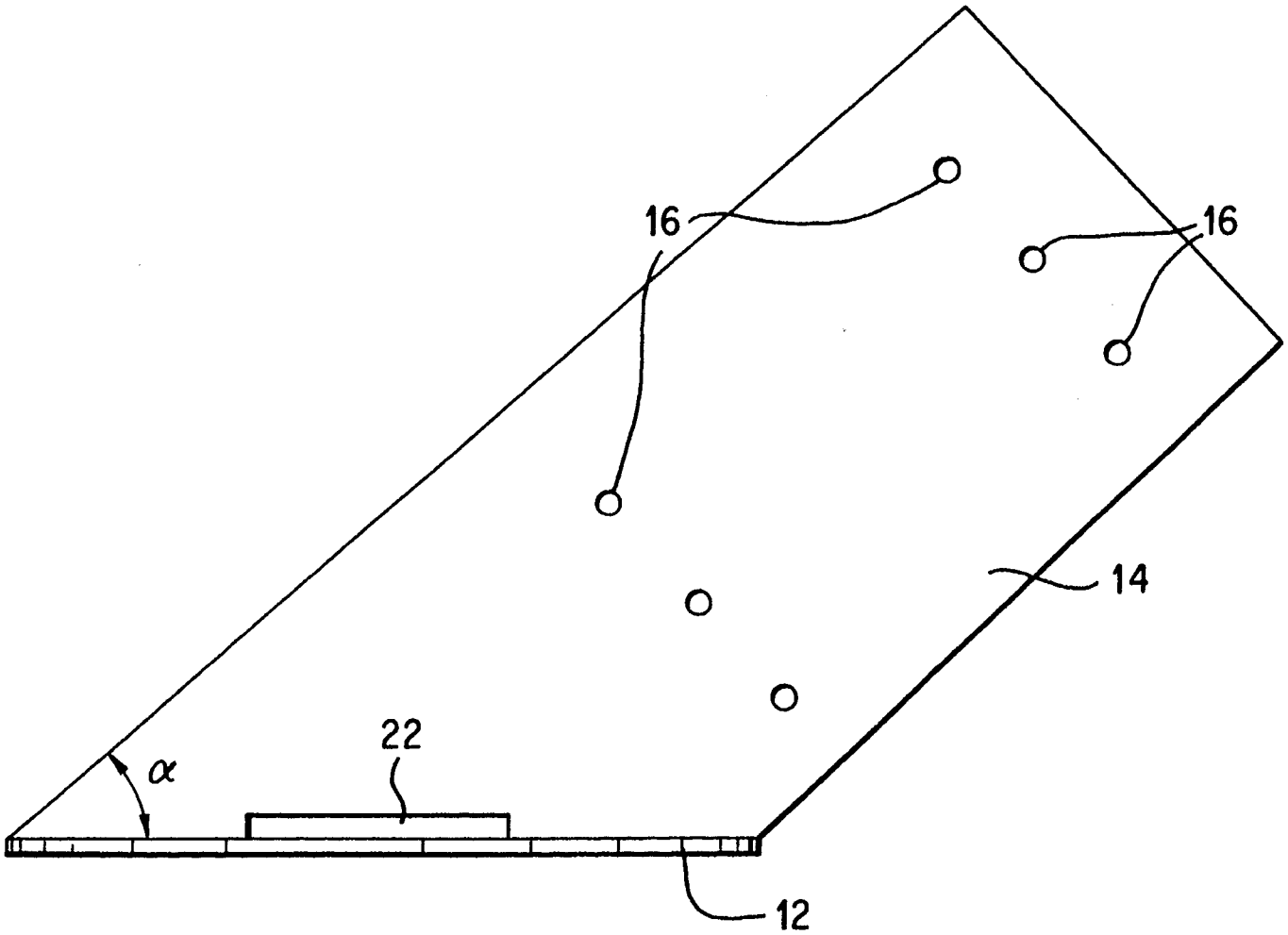
FIG. 2 is a side elevational view of the brace plate shown in FIG. 1.
Figure 3:
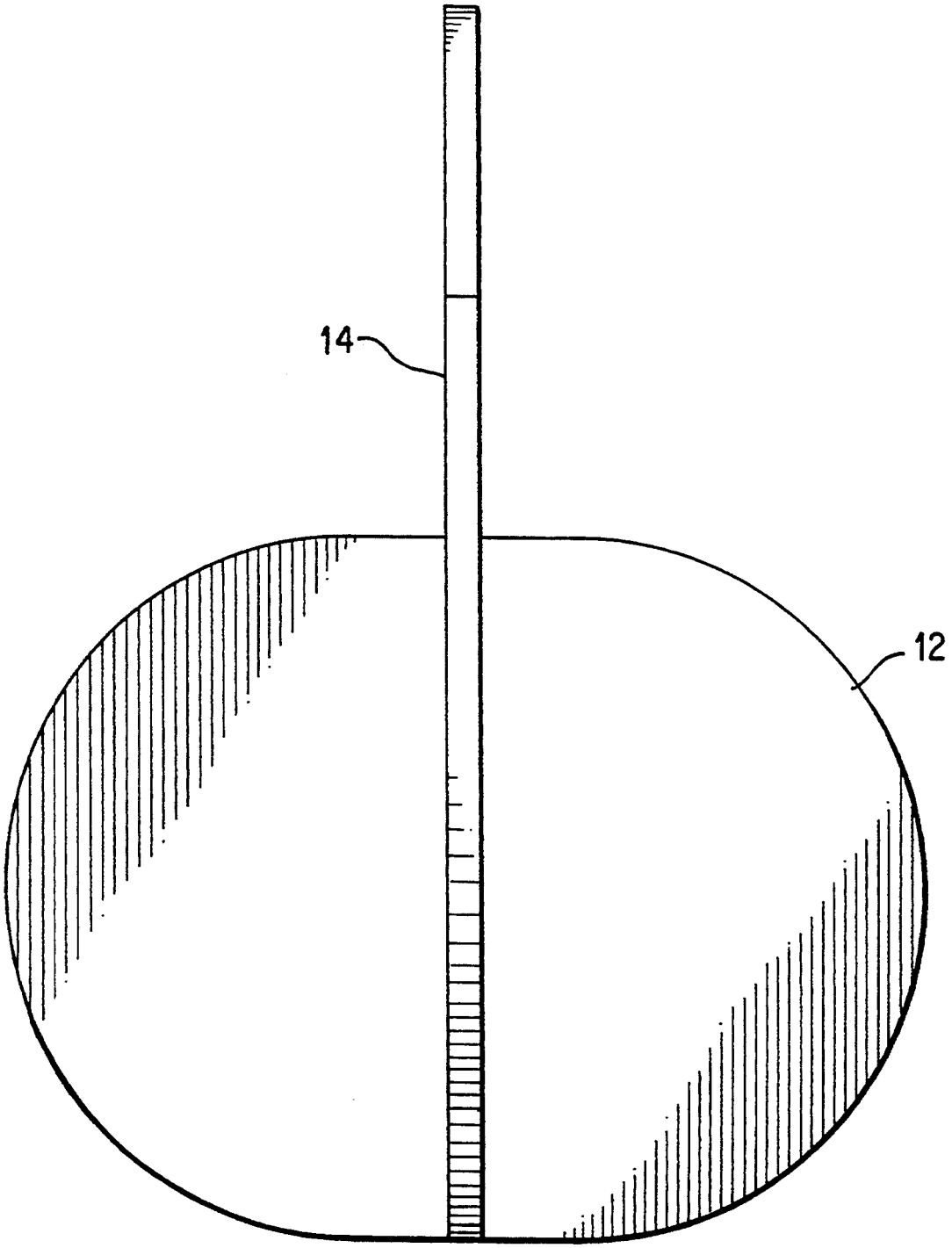
FIG. 3 is a top plan view of the adjustable brace plate shown in FIG. 1.

As shown in FIGS. 1–3, each brace plate 10 according to the present invention includes a base 12 and an extension 14. The base 12 is preferably oblong, although other suitable shapes may be used. The base is preferably formed of a plastic material having sufficient resiliency or flexibility that the base can be placed flush on the outer circumference of a round column form and conform to the shape of the column form. One such suitable plastic material is polypropylene. Of course, suitable non-plastic materials may be used as long as the resulting base is sufficiently flexible to conform to the column form.

Extension 14 extends from the upper face of base 12 at an angle $\alpha$, as shown in FIG. 2. The optimum bracing angle is from 30° to 45°, and thus the angle $\alpha$ is preferably within this range. An angle $\alpha$ of 40° has been found to be particularly suitable.

The extension may be formed of the same material as the base 12, but should be thicker so as to be more rigid. For example, in one preferred embodiment, the base 12 is 1/16 of an inch thick, while the extension 14 is $\frac{1}{4}$ of an inch thick. It is envisioned that the base 12 and extension 14 may be integrally molded using known injection molding or other molding techniques, or may be formed separately and then attached by welding or the like.

The extension 14 has at least two holes 16, and preferably more, formed therein. The holes are preferably arranged in two lines or sets along the extension. These holes accommodate a fastener 18, preferably a single double-headed nail, which fastens the extension 14 to a corresponding brace 20. The brace is preferably a wood brace of the type commonly used in the industry, although any suitable brace can be used.

Figure 4:
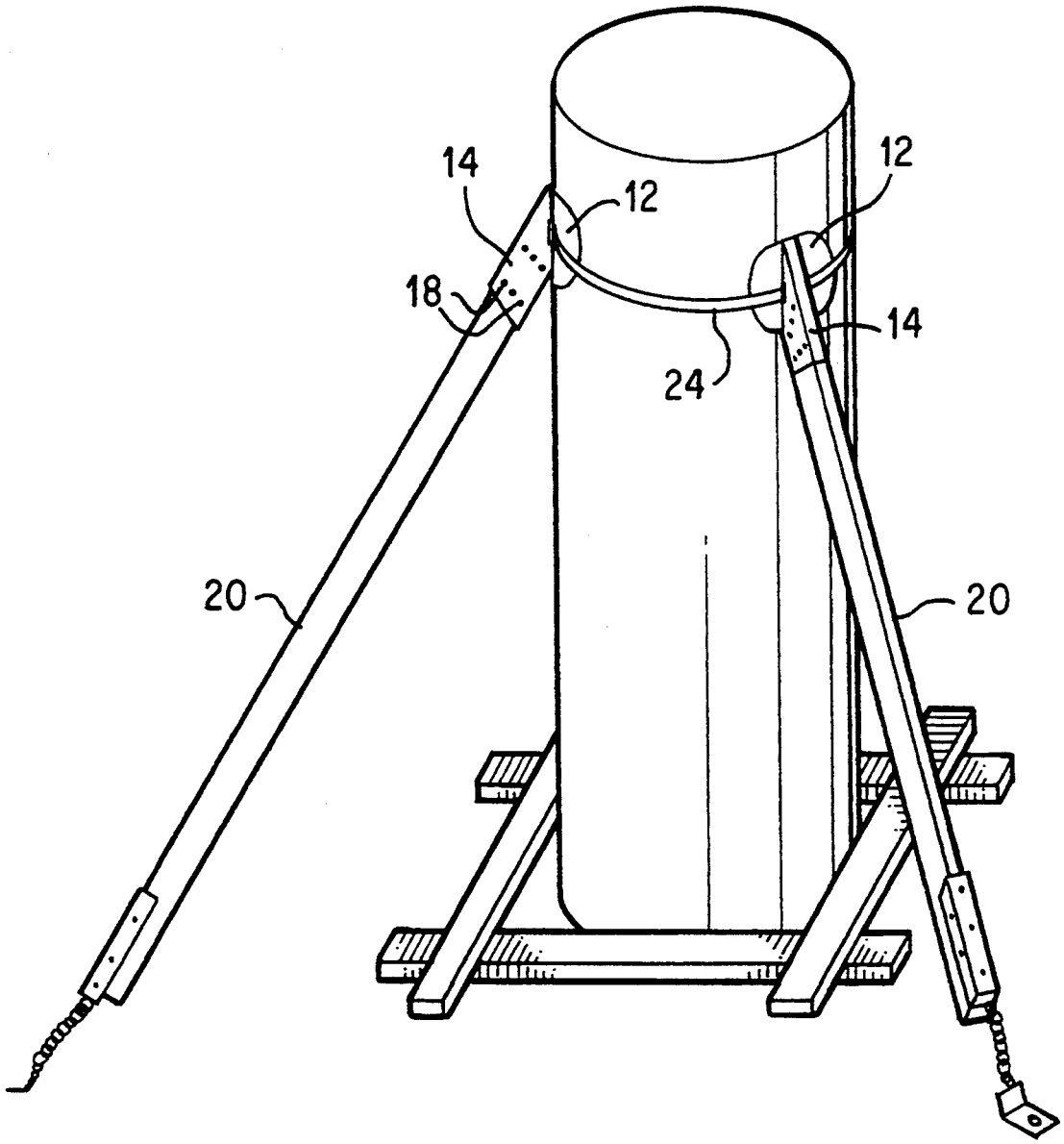
FIG. 4 is a perspective view showing the adjustable bracing system to brace a concrete column form including a plurality of brace plates and wood braces and a tightening strap to brace a concrete column form.

As shown particularly in FIG. 2, a slot 22 is formed in extension 14 at approximately the line where extension 14 meets base 12. This slot is formed of sufficient width that a tightening strap 24, shown in FIG. 4, can be inserted therethrough. The tightening strap is formed of any suitable materials, for example, cotton webbing. The length of the tightening strap is chosen so as to accommodate the largest anticipated diameter of column form. Of course, the tightening strap may be tightened so as to accommodate smaller diameters as well. In this way, the present invention is adjustable and is not limited to a particular diameter column form.

In use, a plurality of brace plates 10 are attached to the tightening strap 24 by running the tightening strap through the slot 22 in each of the brace plates. The tightening strap is wrapped around the column form, the base of each brace plate is placed substantially flush against the column and the strap is drawn snugly around the column form. In the preferred embodiment shown in FIG. 4, two brace plates 10 are arranged 90° apart on the outer surface of the column form. The base plates can be placed essentially anywhere along the length of the column form, and need not be placed adjacent the top end of the column form. Also, although a round column form is shown, it is to be understood that the present invention is not limited by the shape of the column form. Moreover, the invention is not limited to use with concrete columns, but may be used for bracing column forms which receive settable material of any type.

Each brace plate is attached to a corresponding wood brace 20 using a single fastener 18 in a hole 16 so that the brace is movable relative to the brace plate. Next, the bases of the wood braces are secured in a conventional manner. Then the column form is adjusted until the column form is properly aligned. Once the column form is set properly, the remaining fasteners 18 are inserted through the corresponding holes 16 to attach each brace plate 10 to its corresponding wood brace 20. The column form is then ready to receive a settable material, such as concrete.

The above is for illustrative purposes only. Modification can be made, particularly with regard to size, shape and arrangement of parts, within the scope of the invention as defined by the appended claims. For example, it is envisioned that on tall column forms, two or more sets of braces may be used at different elevations along the form to allow for alignment of the form as the settable material is poured.

I claim:

1. A system for bracing a column form, said system comprising:

a plurality of brace plates, each said brace plate including a base formed of a flexible material and an extension extending from said base, said extension having brace fastening means for mounting a brace thereto;

a strap accommodated within a plurality of slots, each of said slots being formed between a respective one of said extensions and its corresponding base; and a plurality of braces corresponding in number to said plurality of brace plates so that each one of said braces is affixed to one of said brace plates via said brace fastening means.

2. A system as claimed in claim 1, wherein two of said brace plates are used, each of said brace plates being spaced 90° from each other on an outer surface of the column form.

3. A system as in claim 1, wherein a plurality of sets of brace plates are used, each set of brace plates being installed at a different elevation along the column form.

4. A method of bracing a column form, said method comprising the steps of:

inserting a strap through a slot in each of a plurality of brace plates;

placing said brace plates against the column form with a base of each brace plate substantially flush against the column form and drawing the strap snugly around the column form;

attaching each one of said brace plates to a corresponding one of a plurality of braces in such a manner as to allow relative movement between each brace plate and its corresponding brace;

securing said braces to the ground;

aligning said column form; and further attaching each brace plate to its corresponding brace so as to prevent relative movement between each brace plate and its corresponding brace.

* * * * *